US005417781A

United States Patent [19]

McQuay et al.

[11] Patent Number: 5,417,781

[45] Date of Patent: May 23, 1995

[54] METHOD TO PRODUCE GAMMA TITANIUM ALUMINIDE ARTICLES HAVING IMPROVED PROPERTIES

[75] Inventors: Paul A. McQuay, Seattle, Wash.; Dennis M. Dimiduk, Beavercreek; Young-Won Kim, Dayton, both of Ohio

[73] Assignee: The United States of America as represented by the Secretary of the Air Force, Washington, D.C.

[21] Appl. No.: 261,312

[22] Filed: Jun. 14, 1994

[51] Int. Cl.[6] ..... C22C 14/00

[52] U.S. Cl. ..... 148/671; 148/421; 148/670; 420/418

[58] Field of Search ..... 148/671, 670, 421; 420/418

[56] References Cited

U.S. PATENT DOCUMENTS

| | | | |
|---|---|---|---|
| 4,294,615 | 10/1981 | Blackburn et al. | 75/175.5 |
| 5,015,305 | 5/1991 | Froes et al. | 148/20.3 |
| 5,045,406 | 9/1991 | Huang | 428/614 |
| 5,152,960 | 10/1992 | Yuki et al. | 148/407 |
| 5,190,603 | 3/1993 | Nazmy et al. | 148/671 |
| 5,226,985 | 7/1993 | Kim et al. | 148/671 |
| 5,232,661 | 8/1993 | Matsuo et al. | 148/421 |
| 5,256,202 | 10/1993 | Hanamura et al. | 148/670 |
| 5,256,218 | 10/1993 | Bakalyar et al. | 148/421 |

FOREIGN PATENT DOCUMENTS

| | | | |
|---|---|---|---|
| 0198639 | 2/1989 | Japan | C22C 14/00 |

OTHER PUBLICATIONS

Masahashi et al in MRS Symp. Proc. 213 vol. 213, 1991, pp. 795–800.

Fukutomi et al Z. Metallkde, 81 (1990) 272.

*Primary Examiner*—Upendra Roy

*Attorney, Agent, or Firm*—Charles E. Bricker; Thomas L. Kundert

[57] ABSTRACT

Gamma titanium aluminide alloy articles having improved properties are produced by the following methods:

The first of these methods comprises the steps of: (a) heat treating an alloy billet or preform at a temperature in the approximate range of $T_\alpha$ to $T_\alpha+100°$ C. for about 0.5 to 8 hours, (b) shaping the billet at a temperature between $T_\alpha-30°$ C. and $T_\alpha$ to produce a shaped article, and (c) aging the thus-shaped article at a temperature between about 750° and 1050° C. for about 2 to 24 hours.

The second method comprises (a) rapidly preheating an alloy preform to a temperature in the approximate range of $T_\alpha$ to $T_\alpha+100°$ C., (b) shaping the billet at a temperature between $T_\alpha$ and $T_\alpha+100°$ C. to produce a shaped article, and (c) aging the thus-shaped article at a temperature between about 750° and 1050° C. for about 2 to 24 hours. The preform is held at the preheat temperature for 0.1 to 2 hours, just long enough to bring the preform uniformly to the shaping temperature.

The third method comprises the steps of: (a) heat treating an alloy billet or preform at a temperature in the approximate range of $T_\alpha$ to $T_\alpha+100°$ C. for about 0.5 to 8 hours, (b) rapidly heating the preform to shaping temperature, if the shaping temperature is greater than the heat treatment temperature, (c) shaping the preform at a temperature between $T_\alpha$ and $T_\alpha+100°$ C. to produce a shaped article, and (d) aging the thus-shaped article at a temperature between about 750° and 1050° C. for about 2 to 24 hours.

The fourth method comprises the steps of: (a) heat treating an alloy billet or preform at a temperature in the approximate range of $T_\alpha-40°$ C. to $T_\alpha$ to for about 0.1 to 2 hours, (b) rapidly preheating the preform to shaping temperature, (c) shaping the preform at a temperature between $T_\alpha$ and $T_\alpha+100°$ C. to produce an shaped article, and (d) aging the thus-shaped article at a temperature between about 750° and 1050° C. for about 2 to 24 hours.

21 Claims, 2 Drawing Sheets

METHOD TO PRODUCE GAMMA TITANIUM ALUMINIDE ARTICLES HAVING IMPROVED PROPERTIES

RIGHTS OF THE GOVERNMENT

The invention described herein may be manufactured and used by or for the Government of the United States for all governmental purposes without the payment of any royalty.

BACKGROUND OF THE INVENTION

The present invention relates to titanium alloys usable at high temperatures, particularly those of the TiAl gamma phase type.

Titanium alloys have found wide use in gas turbines in recent years because of their combination of high strength and low density, but generally, their use has been limited to below 600° C., due to inadequate strength and oxidation properties. At higher temperatures, relatively dense iron, nickel, and cobalt base super-alloys have been used. However, lightweight alloys are still most desirable, as they inherently reduce stresses when used in rotating components.

Considerable work has been performed since the 1950's on lightweight titanium alloys for higher temperature use. To be useful at higher temperature, titanium alloys need the proper combination of properties. In this combination are properties such as high ductility, tensile strength, fracture toughness, elastic modulus, resistance to creep, fatigue and oxidation, and low density. Unless the material has the proper combination, it will not perform satisfactorily, and thereby be use-limited. Furthermore, the alloys must be metallurgically stable in use and be amenable to fabrication, as by casting and forging. Basically, useful high temperature titanium alloys must at least outperform those metals they are to replace in some respect, and equal them in all other respects. This criterion imposes many restraints and alloy improvements of the prior art once thought to be useful are, on closer examination, found not to be so. Typical nickel base alloys which might be replaced by a titanium alloy are INCO 718 or IN100.

Heretofore, a favored combination of elements with potential for higher temperature use has been titanium with aluminum, in particular alloys derived from the intermetallic compounds or ordered alloys $Ti_3Al$ (alpha-2) and TiAl (gamma). Laboratory work in the 1950's indicated these titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.

Those skilled in the art recognize that there is a substantial difference between the two ordered titanium-aluminum intermetallic compounds. Alloying and transformational behavior of $Ti_3Al$ resemble those of titanium as they have very similar hexagonal crystal structures. However, the compound TiAl has a face-centered tetragonal arrangement of atoms and thus rather different alloying characteristics. Such a distinction is often not recognized in the earlier literature. Therefore, the discussion hereafter is largely restricted to that pertinent to the invention, which is within the TiAl gamma phase realm, i.e., about 50 Ti–50 Al atomically and about 65 Ti–35 Al by weight.

Room temperature tensile ductility as high as 4% has been achieved in two-phase gamma alloys based on Ti-48Al such as Ti-48Al-(1–3)X, where X is Cr, V or Mn. This improved ductility was possible when the material was processed to have a duplex microstructure consisting of small equiaxed gamma grains and lameliar colonies/grains. Under this microstructural condition, however, other important properties including low temperature fracture toughness and elevated temperature, i.e., greater than 700° C., creep resistance are unacceptably low. Research has revealed that an all-lamellar structure dramatically improves toughness and creep resistance. Unfortunately, however, these improvements are accompanied by substantial reductions in ductility and strength. Recent experiments have shown that the improved fracture toughness and creep resistance are directly related to the features of lameliar structure, but that the large gamma grain size characteristic of fully-lamellar gamma alloys is responsible for the lowered tensile properties. These experiments have also demonstrated that the normally large grain size in fully-lamellar microstructure can be refined.

Kim et al, U.S. Pat. No. 5,226,985, issued Jul. 13, 1993, describe two methods for refining the microstructure of gamma titanium aluminide alloys. The first method is referred to as a thermomechanical process (TMP) and comprises shaping the article by extrusion or hot die forging, rolling or swaging, followed by a stabilization aging treatment. Where shaping is by extrusion, extrusion is carried out at a temperature in the approximate range of 0° to 20° C. below the alpha-transus temperature of the alloy. The alpha-transus temperature ($T_\alpha$) generally ranges from about 1300° to about 1400° C., depending on the alloy composition. $T_\alpha$ decreases with decreasing Al. The transus temperature has also been shown to decrease with many interstitial (e.g., O and C) and substitutional (e.g., Cr, Mn, Ta and W) alloying elements. $T_\alpha$ can be determined relatively routinely by standard isothermal heat treatments and metallography, or by Differential Thermal Analysis (DTA), provided the material is homogeneous.

The aging temperature can range between 750° and 1100° C., depending on the specific use temperature contemplated, for at least one hour and up to 300 hours. Where shaping is by hot die forging, rolling or swaging, such shaping is carried out at a temperature in the approximate range of 50° C. above $T_\epsilon$, the eutectoid temperature of two-phase gamma alloys ($\approx$1130° C.), to about 0° to 20° C. below $T_\alpha$, at a reduction of at least 50% and a rate of about 5–20 mm/min.

The second method is referred to as a thermomechanical treatment (TMT), which comprises hot working at temperatures well below the alpha-transus ($T_\alpha$) with subsequent heat treatment near the alpha-transus, followed by a stabilization aging treatment. Where shaping is by extrusion, extrusion is carried out at a temperature in the approximate range of $T_\epsilon-130°$ C. to $T_\alpha-20°$ C. Where shaping is by hot die forging, rolling or swaging, such shaping is carried out at a temperature in the approximate range of $T_\epsilon-130°$ C. to $T_\alpha 20°$ C., at a reduction of at least 50% and a rate of about 5–20 mm/min. Where shaping is by isothermal forging, such shaping is carried out at a temperature in the approximate range of $T_\epsilon-130°$ C. to $T_\epsilon+100°$ C., at a reduction of at least 60% and a rate of about 2–7 mm/min. After hot working, the article is heat treated at a temperature in the approximate range of $T_\alpha-5°$ C. to $T_\alpha+20°$ C. for about 15 to 120 minutes. Following such heat treatment, the article is cooled and given an aging treatment.

Kim et al is a valuable contribution to the art. The TMP method disclosed therein provides a product with a fine lameliar microstructure. The TMT method provides a product having a fine, randomly oriented lameliar microstructure.

We have discovered that the processing window can be extended, thus allowing for more realistic and reliable foundry practice. This newly discovered hot working temperature range will generate unique lameliar microstructures consisting of randomly oriented lameliar colonies, with serrated grain boundaries. Gamma titanium aluminide alloys with this structure have the requisite balance of properties for moderate and high temperature aerospace applications: high specific strength, stiffness, fracture resistance and creep resistance in the temperature range of room temperature to about 950° C.

Accordingly, it is an object of the present invention to provide improved methods for producing articles of gamma titanium aluminide alloys.

Other objects and advantages of the invention will be apparent to those skilled in the art.

SUMMARY OF THE INVENTION

In accordance with the invention, there are provided improved methods for producing articles of gamma titanium aluminide alloy having improved properties:

The first of these methods comprises the steps of:

(a) heat treating an alloy billet or preform at a temperature in the approximate range of $T_\alpha$ to $T_\alpha+100°$ C. for about 0.5 to 8 hours, (b) shaping the billet at a temperature between $T_\alpha-30°$ C. and $T_\alpha$ to produce a shaped article, and (c) aging the thus-shaped article at a temperature between about 750° and 1050° C. for about 2 to 24 hours.

The second method comprises (a) rapidly preheating an alloy preform to a temperature in the approximate range of $T_\alpha$ to $T_\alpha+100°$ C., (b) shaping the billet at a temperature between $T_\alpha$ to and $T_\alpha+100°$ C. to produce a shaped article, and (c) aging the thus-shaped article at a temperature between about 750° and 1050° C. for about 2 to 24 hours. The preform is held at the preheat temperature for 0.1 to 2 hours, just long enough to bring the preform uniformly to the shaping temperature.

The third method comprises the steps of:

(a) heat treating an alloy billet or preform at a temperature in the approximate range of $T_\alpha$ to $T_\alpha+100°$ C. for about 0.5 to 8 hours, (b) rapidly heating the preform to shaping temperature, if the shaping temperature is greater than the heat treatment temperature, (c) shaping the preform at a temperature between $T_\alpha$ and $T_\alpha+100°$ C. to produce a shaped article, and (d) aging the thus-shaped article at a temperature between about 750° and 1050° C. for about 2 to 24 hours.

The fourth method comprises the steps of:

(a) heat treating an alloy billet or preform at a temperature in the approximate range of $T_\alpha-40°$ C. to $T_\alpha$ to for about 0.1 to 2 hours, (b) rapidly preheating the preform to shaping temperature, (c) shaping the preform at a temperature between $T_\alpha$ and $T_\alpha+100°$ C. to produce an shaped article, and (d) aging the thus-shaped article at a temperature between about 750° and 1050° C. for about 2 to 24 hours.

DETAILED DESCRIPTION OF THE INVENTION

Figure 1:
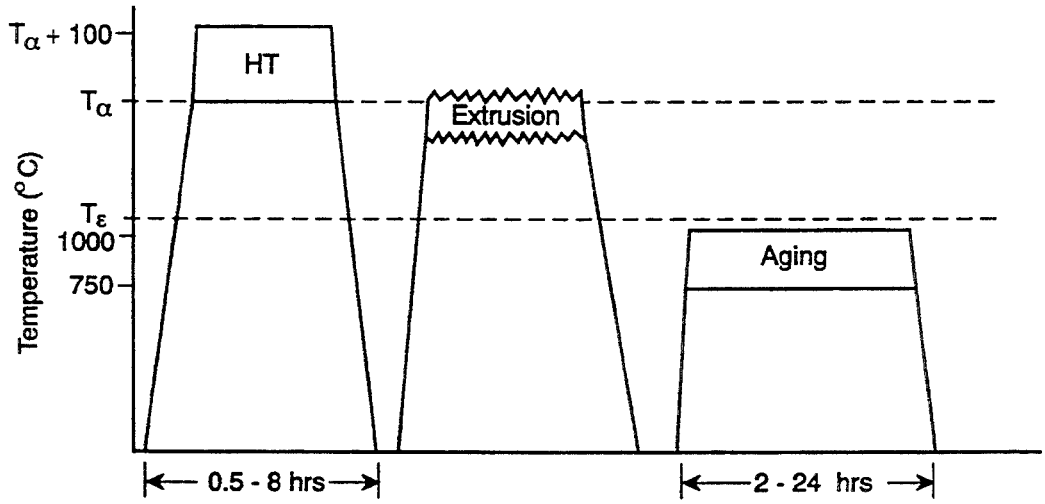
FIG. 1 is a schematic illustration of the first method described previously.

The titanium-aluminum alloys suitable for use in the present invention are those alloys containing about 40 to 50 atomic percent Al (about 27 to 36 wt %), balance Ti. The methods of this invention are applicable to the entire composition range of two-phase gamma alloys which can be formulated as:

Binaries: Ti-(45–49)Al (at %);

Multi-component alloys:

Ti-(45–49)Al-(1–3)X-(2–6)Y, where X is Cr, V, Mn, W or any combination thereof, and Y is Nb, Ta or any combination thereof (at %);

Above alloys with additions of small amounts (0.05–2.0 at %) of Si, B, P, Se, Te, Ni, Fe, Ce, Er, Y, Ru, Sc or Sn, or any combination thereof.

Examples of suitable alloy compositions include

Ti-46Al-2Cr-0.5Mn-0.5Mo-2.5Nb (at %),

Ti-47.5Al-2Cr-1V-0.2Ni-2Nb (at %),

Ti-47.3Al-1.5Cr-0.4Mn-0.5Si-2Nb (at %),

Ti-47Al-1.6Cr-0.9V-2.3Nb (at %),

Ti-47Al-1Cr-4Nb-1Si (at %) and

Ti-(46–48)Al (at %).

The starting materials are alloy ingots or consolidated powder billets, preferably in the hot isostatically pressed (HIP'd) condition.

It is also within the scope of the invention to employ gamma alloys containing small volume fractions of a third phase, i.e., metallic carbides, silicides or borides, or other ceramic or metalloid phases.

Shaping is carried out at a temperature in the approximate range of $T_\alpha-20°$ C. to $T_\alpha+100°$ C., depending on which method, described above, is used. The thermomechanical method employed for shaping the preform can be extrusion or very high temperature hot die forging, swaging or rolling. In these processes, it is preferable that the billets be protected by a sacrificial can, as is employed in hot die extrusion. Where extrusion is employed, the parameters suitable for producing the desired microstructure include extrusion ratios between 4:1 and 20:1, and extrusion rates between 12 mm/sec and 25 mm/sec.

Heat treatment of the preform is carried out at a temperature in the approximate range of $T_\alpha-40°$ C. to $T_\alpha+100°$ C., depending on which method, described above, is used, for about 0.1 to 8 hours, also depending on which method is used. The preform should be heated to heat treatment temperature at a rate of at least about 200° C./minute. Following such heat treatment, the preform is shaped, as discussed above.

The aging temperature can range between 750° and 1050° C., depending on the specific use temperature contemplated. Aging time should be at least 1, preferably 2, hours and can be as long as possible; however, 24 hours appears to be adequate. Aging can be accomplished by slow, furnace cooling, by packing the shaped article in a suitable insulating medium, or, in some cases, by air cooling.

FIGS. 1–4 illustrate the methods described previously as applied to extrusion of a gamma titanium aluminide preform. Referring to FIG. 1, the preform is heated rapidly to heat treatment temperature and held there for 0.25 to 10 hours. Heat treatment time depends on the heating method, preform size and cross-section, and microstructure. The preform is then cooled, preferably slow-cooled, to extrusion temperature and extruded.

Figure 2:
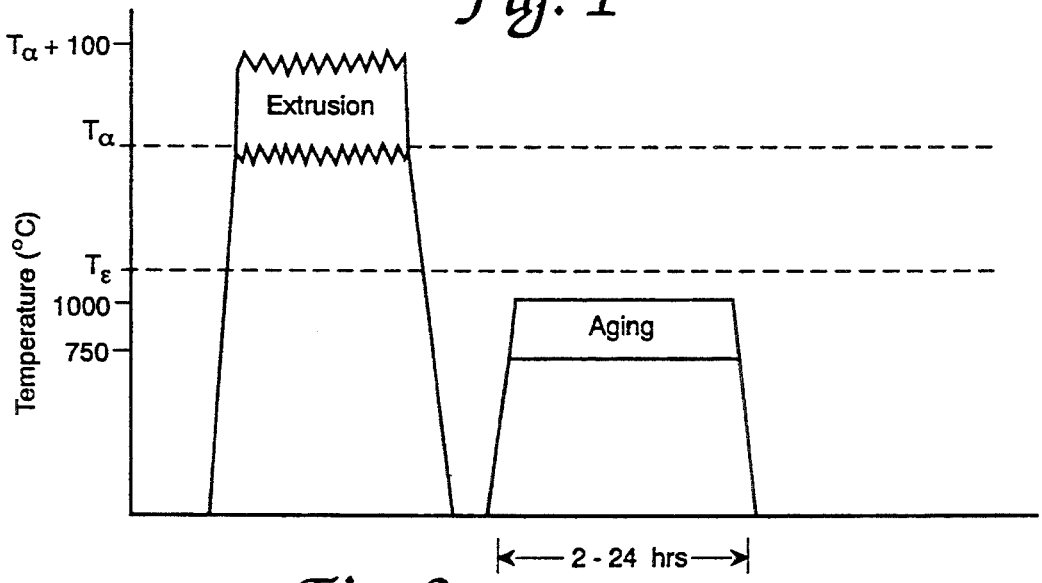
FIG. 2 is a schematic illustration of the second method described previously.
Figure 3:
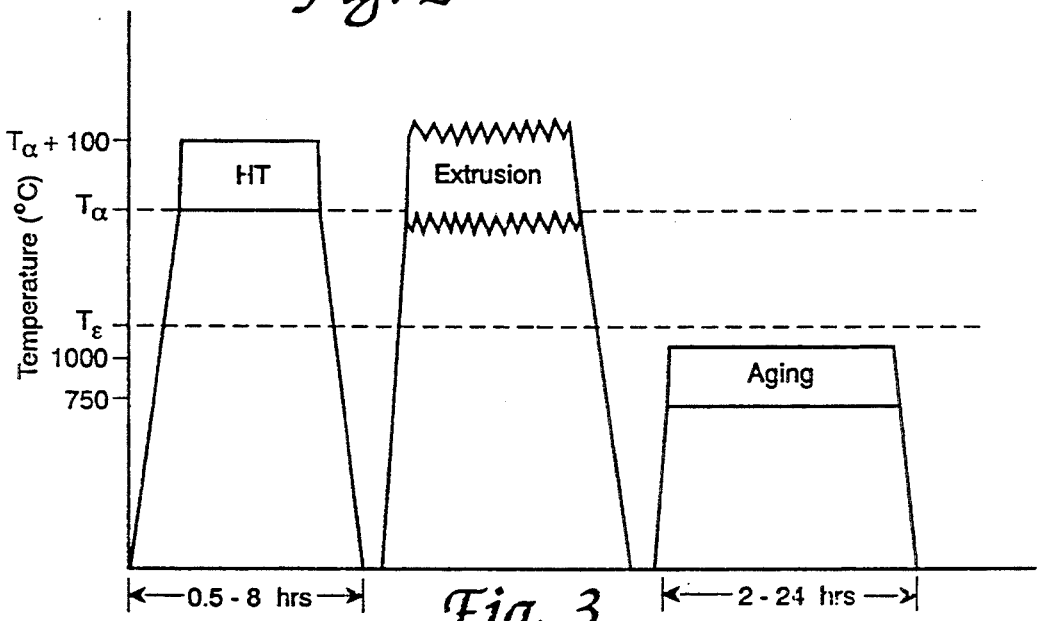
FIG. 3 is a schematic illustration of the third method described previously.

Referring to FIG. 2, the preform is heated rapidly to extrusion temperature and held for 0.1 to 2 hours, just long enough to bring the preform uniformly to extrusion temperature, then shaped. Rapid heating of the preform to the extrusion temperature can be accomplished by insertion into a furnace at the extrusion temperature, or by induction heating. The preform is transferred to the extrusion apparatus as rapidly as possible to ensure limited cooling of the preform. Referring to FIG. 3, it can be seen that this method differs from the first method in that extrusion is carried out at a higher temperature, i.e., $T_\alpha$ to $T_\alpha+100°$ C. If the heat treatment temperature is below the desired extrusion temperature, it is necessary to heat the preform rapidly to extrusion temperature, holding long enough to achieve a uniform extrusion temperature throughout the preform. The preform is transferred to the extrusion apparatus as rapidly as possible to ensure limited cooling of the preform.

Figure 4:
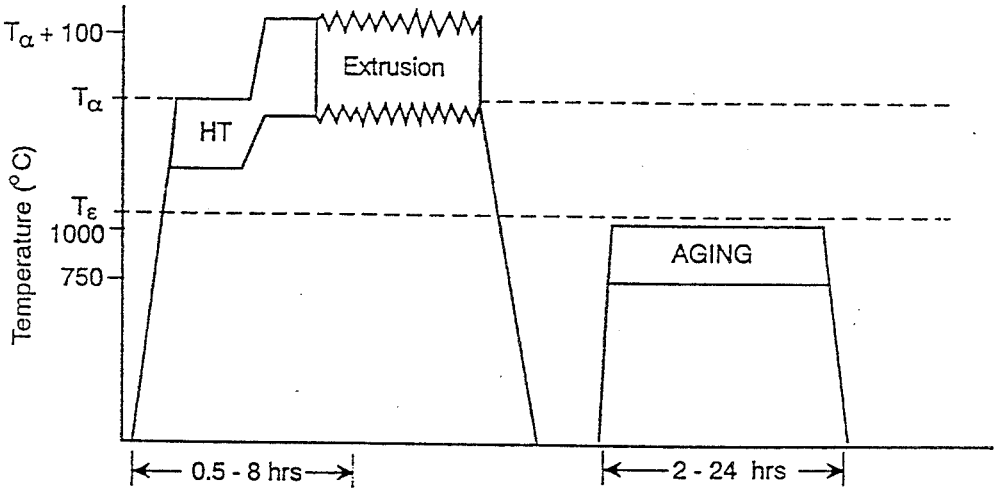
FIG. 4 is a schematic illustration of the fourth method described previously.
Figure 5:
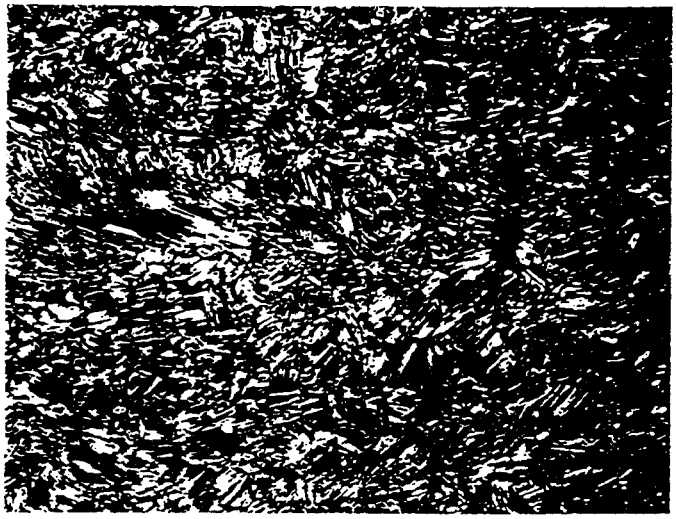
FIG. 5 is a 33X photomicrograph illustrating the TMP Lameliar structure produced by shaping Ti-48Al.
Figure 6:
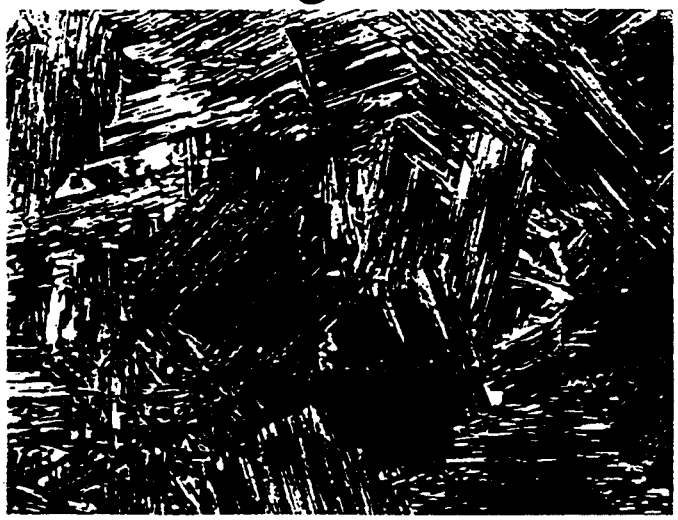
FIG. 6 is a 200X photomicrograph illustrating the TMP Lameliar structure produced by shaping Ti-48Al.

Referring to FIG. 4, it can be seen that the heat treatment temperature is well below the extrusion temperature. This treatment is a soaking treatment which is adequate to heat the preform uniformly in order to limit nonuniform grain growth. The preform is then rapidly heated to extrusion temperature, holding long enough to achieve a uniform extrusion temperature throughout the preform. The preform is transferred to the extrusion apparatus as rapidly as possible to ensure limited cooling of the preform.

The following example illustrates the invention. In the runs which follow, the alloys used are identified as:

| Alloy No. | Composition | $T_\alpha$ (°C.) (approximate) |
|---|---|---|
| I | Ti-48Al | 1380 |
| II | Ti-48Al-2Mn-2Nb | 1370 |
| III | Ti-48Al-2Cr-2Nb | 1370 |

Run I

A billet of Alloy I was heated to 1380° C. and held for 4 hours. The heat treated billet was cooled to about 1350° C. over a period of about 20 minutes, then extruded at about 1350° C. with a die ratio of 6.5:1, then slowly cooled to room temperature. The resulting microstructure was relatively fine-grained, recrystallized lameliar (hereinafter referred to as TMP Lameliar).

Run II

A billet of Alloy I was heated to 1380° C. and held for 6 hours, then cooled to about 1360° C. and held for 2 hours, then extruded at about 1360° C. with a die ratio of 6.1:1, then air cooled to room temperature. The resulting microstructure was Deformed Fully Lameliar (DFL).

Run III

A billet of Alloy I was heated to 1360° C. and held for 2 hours, then extruded at about 1360° C. with a die ratio of 6.1:1, then air cooled to room temperature. The resulting microstructure was Duplex, i.e., lameliar (L) grains and primary gamma ($\gamma$) grains.

Run IV

A billet of Alloy I was heated to 1380° C. and held for 2 hours, then extruded at about 1380° C. with a die ratio of 6.3:1, then air cooled to room temperature. The resulting microstructure was Nearly Lameliar.

Run V

A billet of Alloy II was heated to 1370° O and held for 2 hours, then extruded at about 1370° C. with a die ratio of 5.8:1, then slowly cooled to room temperature. The resulting microstructure was TMP +DFL.

Run VI

A billet of Alloy II was heated to 1370° C., held for 2 hours, then heated to 1400° C. and held for 30 minutes then extruded at about 1400° C. with a die ratio of 5.8:1, then slowly cooled to room temperature. The resulting microstructure was TMP+DFL.

Run VII

A billet of Alloy III was heated to 1380° C. and held for 2 hours, then extruded at about 1380° C. with a die ratio of 6.1:1, then air cooled to room temperature. The resulting microstructure was TMP+DFL.

These runs demonstrate the variety of microstructures attainable by way of the methods of the instant invention. The TMP Lameliar microstructure provides the best balance of properties as shown in the following table, wherein the physical properties of an extrusion prepared according to the invention and having this microstructure is compared to the properties of other microstructures:

| Microstructure | YS (ksi) | UTS (ksi) | EL (%) | K (ksi-in$^{-2}$) |
|---|---|---|---|---|
| Duplex ($\gamma$ + L) | 65 | 80 | 3–4 | 12 |
| Nearly Lamellar | 90 | 105 | 2–2.5 | 14 |
| Fully Lamellar | 50 | 75 | 0.4–0.9 | 22–30 |
| TMP Lamellar | 85 | 100 | 1.5–2.5 | 25–30 |

Various modifications may be made to the invention as described without departing from the spirit of the invention or the scope of the appended claims.

We claim:

1. A method for producing articles of gamma titanium aluminide alloy having improved properties which comprises the steps of:
   (a) heat treating an alloy preform at a temperature in the approximate range of $T_\alpha$ to $T_\alpha+100°$ C. for about 0.5 to 8 hours,
   (b) shaping the preform at a temperature between $T_\alpha$ and $T_\alpha-30°$ C. to produce a shaped article, and
   (c) aging the thus-shaped article at a temperature between about 750° and 1050° C. for about 2 to 24 hours.

2. The method of claim 1 wherein said preform is shaped by extrusion at an extrusion ratio between 4:1 and 20:1 and an extrusion rate between 12 mm/sec and 25 mm/sec.

3. The method of claim 1 wherein said alloy has the composition Ti-48Al.

4. The method of claim 1 wherein said alloy has the composition Ti-48Al-2Mn-2Nb.

5. The method of claim 1 wherein said alloy has the composition Ti-48Al-2Cr-2Nb.

6. The method of claim 1 wherein said alloy has the composition Ti-48Al, wherein said preform is heat treated at 1380° C. for 4 hours, cooled to 1350° C., and extruded at 1350° C. at an extrusion ratio of 6.5:1 and slow cooled to room temperature.

7. A method for producing articles of gamma titanium aluminide alloy having improved properties which comprises the steps of:
   (a) rapidly preheating an alloy preform to a temperature in the approximate range of $T_\alpha$ to $T_\alpha+50°$ C.,
   (b) shaping the preform at a temperature between $T_\alpha$ and $T_\alpha+100°$ C. to produce a shaped article, and
   (c) aging the thus-shaped article at a temperature between about 750° and 1050° C. for about 2 to 24 hours.

8. The method of claim 7 wherein said preform is shaped by extrusion at an extrusion ratio between 4:1 and 20:1 and an extrusion rate between 12 mm/sec and 25 mm/sec.

9. The method of claim 7 wherein said alloy has the composition Ti-48Al.

10. The method of claim 7 wherein said alloy has the composition Ti-48Al-2Mn-2Nb.

11. The method of claim 7 wherein said alloy has the composition Ti-48Al-2Cr-2Nb.

12. A method for producing articles of gamma titanium aluminide alloy having improved properties which comprises the steps of:
   (a) heat treating an alloy preform at a temperature in the approximate range of $T_\alpha$ to $T_\alpha+100°$ C. for about 0.5 to 8 hours,
   (b) adjusting the temperature of the preform to shaping temperature,
   (c) shaping the preform at a temperature between $T_\alpha$ and $T_\alpha+100°$ C. to produce a shaped article, and
   (d) aging the thus-shaped article at a temperature between about 750° and 1050° C. for about 2 to 24 hours.

13. The method of claim 12 wherein said preform is shaped by extrusion at an extrusion ratio between 4:1 and 20:1 and an extrusion rate between 12 mm/sec and 25 mm/sec.

14. The method of claim 12 wherein said alloy has the composition Ti-48Al.

15. The method of claim 12 wherein said alloy has the composition Ti-48Al-2Mn-2Nb.

16. The method of claim 12 wherein said alloy has the composition Ti-48Al-2Cr-2Nb.

17. A method for producing articles of gamma titanium aluminide alloy having improved properties which comprises the steps of:
   (a) heat treating an alloy preform at a temperature in the approximate range of $T_{\cong}-40°$ C. to $T_\alpha$ for about 0.1 to 2 hours,
   (b) rapidly heating the preform to shaping temperature,
   (c) shaping the preform at a temperature between $T_\alpha$ and $T_\alpha+100°$ C. to produce an shaped article, and
   (d) aging the thus-shaped article at a temperature between about 750° and 1050° C. for about 2 to 24 hours.

18. The method of claim 17 wherein said preform is shaped by extrusion at an extrusion ratio between 4:1 and 20:1 and an extrusion rate between 12 mm/sec and 25 mm/sec.

19. The method of claim 17 wherein said alloy has the composition Ti-48Al.

20. The method of claim 17 wherein said alloy has the composition Ti-48Al-2Mn-2Nb.

21. The method of claim 17 wherein said alloy has the composition Ti-48Al-2Cr-2Nb.

* * * * *